United States Patent [19]

Murphy et al.

[11] Patent Number: 5,074,752

[45] Date of Patent: Dec. 24, 1991

[54] GAS TURBINE OUTLET GUIDE VANE MOUNTING ASSEMBLY

[75] Inventors: Guy C. Murphy, Fairfield; Frederic G. Haaser; Anthony J. Matacia, both of Cincinnati, all of Ohio

[73] Assignee: General Electric Company, Cincinnati, Ohio

[21] Appl. No.: 563,148

[22] Filed: Aug. 6, 1990

[51] Int. Cl.[5] ..... F01D 1/04

[52] U.S. Cl. ..... 415/209.4; 415/119; 415/191

[58] Field of Search ..... 415/209.3, 209.2, 209.4, 415/210.1, 211.2, 208.1, 191, 156, 119

[56] References Cited

U.S. PATENT DOCUMENTS

| | | | |
|---|---|---|---|
| 3,778,184 | 12/1973 | Wood | 415/209.4 |
| 3,857,649 | 12/1974 | Schaller et al. | 415/200 |
| 3,867,066 | 2/1975 | Canova et al. | 415/209.3 |
| 3,910,716 | 10/1975 | Roughgarden et al. | 415/217 |
| 4,305,696 | 12/1981 | Pask | 415/209.2 |
| 4,655,682 | 4/1987 | Kunz et al. | 415/209.4 |
| 4,820,120 | 4/1989 | Feuvrier et al. | 415/189 |
| 4,832,568 | 5/1989 | Roth et al. | 415/189 |
| 4,940,386 | 7/1990 | Feuvrier et al. | 415/209.2 |

*Primary Examiner*—Edward K. Look
*Assistant Examiner*—Christopher M. Verdier
*Attorney, Agent, or Firm*—Jerome C. Squillaro; James P. Davidson

[57] ABSTRACT

A guide vane mounting assembly for outlet guide vanes adjacent the fan of a bypass gas turbine engine comprises a wedge shaped end section on a vane and a wedge shaped elastomer material boot closely fitting thereon. The wedge shaped booted section resides in an oppositely shaped slot in a vane support to provide a dovetail joint with the elastomer material boot compressed between the wedge section of the vane and the slot walls as a vibration damping medium and vane retention means.

9 Claims, 3 Drawing Sheets

GAS TURBINE OUTLET GUIDE VANE MOUNTING ASSEMBLY

BACKGROUND OF THE INVENTION

This invention relates to an air flow control vane for mounting in an air duct in an air flow stream therein, and more particularly to a fan outlet guide vane assembly for hot gas turbine engines employing fan inlet or fan bypass stator vanes. Guide vanes as described ordinarily comprise an airfoil vane structure radially supported in a hot gas turbine engine between an inner circumferential support and an outer circumferential support or casing. It is imperative that the guide vanes be more firmly retained in their supports in such a manner to resist imposed stresses from temperature expansion characteristics of the materials utilized and to be resistant to vibration. Additionally the structures involved may utilize composite materials including nonmetallics and ceramics and it is desirable that the vane mounting assembly be advantageously accommodating for those materials as well as to provide positive retention of the vane over its range of operating conditions.

OBJECTS OF THE INVENTION

It is an object of this invention to provide an improved outlet guide vane mounting assembly for hot gas turbine engines.

It is another object of this invention to provide an improved guide vane and support platform subassembly mounting structure to fit a fan outlet guide vane in its operative position in a hot gas turbine engine.

It is a further object of this invention to provide a resilient material member as an alignment and positioning element which interfits between a guide vane and its support to accurately fixedly position a vane to its support.

It is yet another object of this invention to provide a preformed predeterminedly shaped elastomer lock boot on a correspondingly predeterminedly shaped vane end to accurately fix the vane to its support in a snap fit relationship.

SUMMARY OF THE INVENTION

In one form of this invention an airfoil shaped guide vane has an end section which is radially flared or wedge shaped with a complementary shaped and preformed elastomer boot fitted thereon. A platform support segment for the vane includes an open slot therein having sidewalls which are complementarily wedge shaped and sized to receive the vane end and boot therein in a dovetail joint relationship. Matching protrusions and indentations between the boot and an adjacent slot wall provide a press in and snap fit assembly.

This invention will be better understood when taken in connection with the following description and drawings.

DESCRIPTION OF PREFERRED EMBODIMENTS

Figure 1:
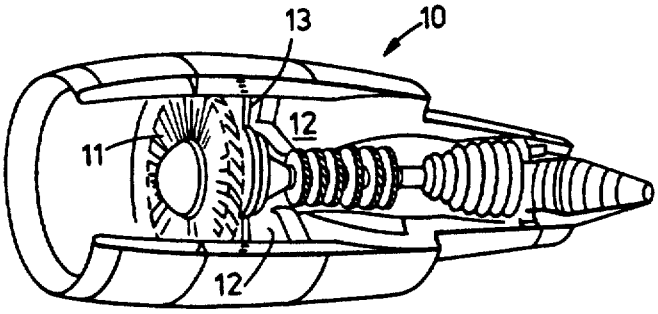
FIG. 1 is a schematic illustration of a hot gas turbine engine to which this invention is applicable.

Referring now to FIG. 1, a hot gas turbine engine 10 is illustrated with its fan 11 generating a flow of air through an annular channel 12. A circumferential row of radially extending air foil, guide vanes 13 are utilized in channel 12 adjacent fan 11 to exert some directional control of the air flow through channel 12. One such guide vane is illustrated in FIG. 2.

Figure 2:
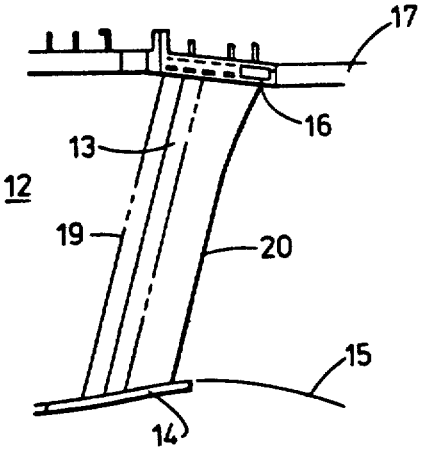
FIG. 2 is a schematic and side elevational view of a fan outlet guide vane structure of a hot gas turbine engine.
Figure 3:
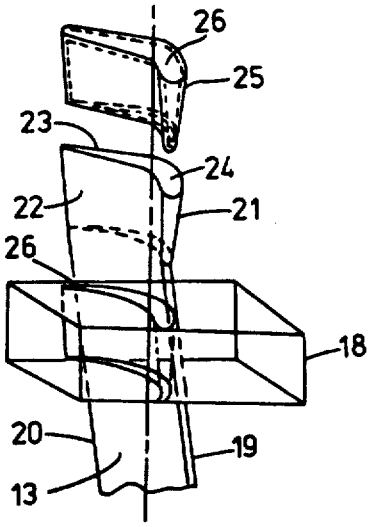
FIG. 3 is a schematic and exploded illustration of one end of an outlet guide vane with its unassembled boot and support platform.

In FIG. 2 guide vane 13 is ordinarily one of a circumferential row of radial guide vanes extending across the annular space 12 of FIG. 1 from a central circumferential part 14 of an engine casing 15 to engage a circumferential part 16 at the engine fan casing 17. Circumferential parts 14 and 16 may be circular rim or band structures or arcuate segments thereof referred to as vane support platforms. In a final assembly circumferential part 16 comprises a plurality of adjacent vane platform segments 18 (FIGS. 3–9) which together form outer ring structure 16 to support a circular row of radially extending vanes. In one example, a plurality of adjacent segments 18 support a total of 80 guide vanes in a circular row in the annular space 12 (FIG. 1). The noted segments 18 may also comprise light weight composite materials and are fixedly secured by bolts, for example, to the adjacent fan casing. Guide vane 13 (FIG. 2) includes a thicker airfoil leading edge 19 tapering to a thinner trailing edge 20 with a cross-section of the usual curved airfoil design (FIG. 3). It is very desirable to employ high strength, light weight materials for guide vanes 13 and included among such materials are nonmetals such as, for example, carbon-epoxy composites. However, it is important that such vanes be securely fixed in their predetermined operative position in a manner which includes some vibration damping or isolation characteristics.

Secure affixation and vibration damping characteristics together with accurate vane positioning are achieved in the present invention by means of the use of a wedge fit mounting assembly utilizing an intermediate elastomer boot element on a wedge shaped end of the guide vanes, with the guide vane end fitted in a wedge shaped slot in its vane support platform in dovetail joint relationship. This arrangement is more clearly shown in FIGS. 3 and 4.

Referring to FIG. 3, vane 13 is illustrated as extending through a vane platform segment 18, but extending only to show that its platform end is radially tapered to provide a radial wedge shaped end section 21. End section 21 conforms to the curved airfoil design of vane 13 by including curved airfoil side surfaces 22 and 23 together with a planar transverse end or base surface 24. A relatively thin wall boot member 25 is slidably fitted on end section 21 of vane 13 and conforms to the wedge or taper as well as to the curved airfoil design of vane 13. Boot 25 provides a resilient and vibration damping barrier between vane 13 and its support platform 18 at the fan casing as more clearly shown in FIG. 4.

Figure 4:
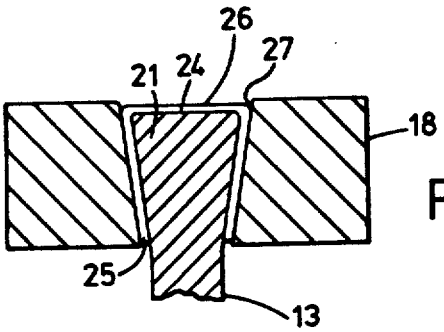
FIG. 4 is a schematic cross-sectional illustration of a dovetail joint formed by the vane mounting assembly of this invention with its platform support.

In FIG. 4, boot 25 is fitted over wedge shaped end 21 of vane 13 with the planar end surface 26 of boot 25 in planar abutting relationship with surface 24 of end section 21. End section 21 with boot 25 thereon resides in a complementary wedge shaped slot 27 in vane platform segment 18 to provide a secure dovetail joint with a layer of resilient boot 25 material as a vibration damping and isolation medium between otherwise contacting and relatively unyielding parts. In the assembly of vane 13 to an outer vane platform segment 18, one end of vane 13 is without a wedge end section and that end is inserted axially into and through slot 27 until the booted wedge shaped end section enters slot 27 in a wedging fit (as shown in FIG. 4) with boot 25 and the sidewalls of slot 27. This wedge fit not only prevents further axial and radial movement of the vane beyond its predetermined position, but also utilizes the walls of slot 27 to compressingly engage boot 25 and the wedge end section 21 of vane 13 in tight fitting relationship. Material for boot 25 may be selected from various synthetic materials but is preferably a Viton elastomer material such as a fluoro rubber, for example, a copolymer of vinylidine fluoride having high temperature and compression set resistance. A further advantage of the use of boot 25 is its ready adaptability to press fit retention as illustrated in FIG. 5.

Figure 5:
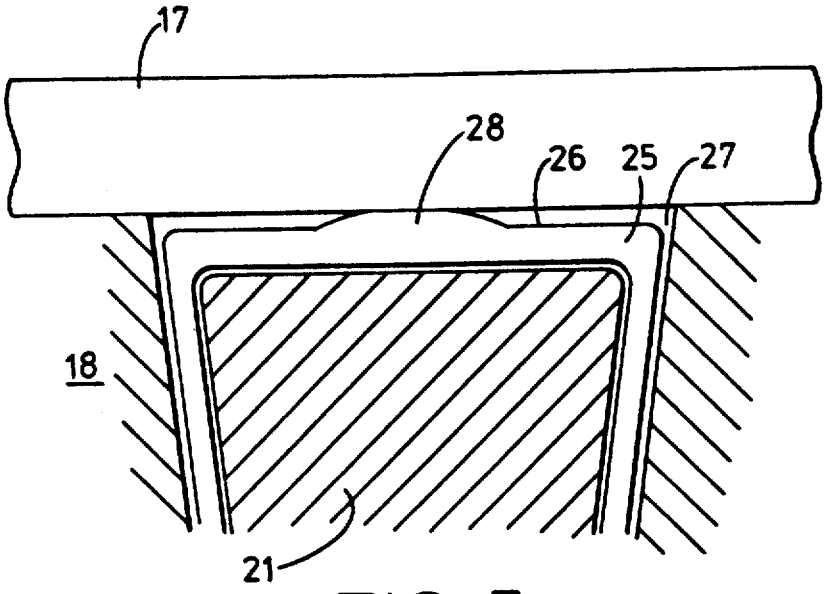
FIG. 5 is an enlarged schematic cross-sectional and partial illustration of the assembled dovetail joint of FIG. 3 including a resilient compression means between the vane wedge shaped end section and an adjacent wall.

Referring now to FIG. 5, boot 25 is illustrated as having a protuberance 28 on its end surface 26. The dimensional design of the joint is predetermined to permit sliding of the radial wedge end section 21 and boot 25 into slot 27 with minimal clearance. In practice, vane platform segment 18 is bolted to fan casing 17 which overlies vane platform segment 18. Vane platform segment 18 is bolted to casing 17 in curved planar abutting relationship and forms a closing transverse wall of slot 27. Accordingly, in this instance protuberance 28 represents an interference fit between segment 18 and its mating surface 17 and must be resiliently compressed in the available space between the base of wedge section 21 and overlying casing 17 when vane platform segment 18 is fitted against casing 17. The compressed resilient protuberance 28 provides a radial force on the dovetail joint for improved retention and rigidity of vane 13. A plurality of such protuberances may be employed on one or more surfaces of boot 24 with the same or differing individual geometries or patterns. Such resilient protuberances may be utilized as more positive retention means as well as vane positioning means as described, for example, with respect to FIG. 6.

Figure 6:
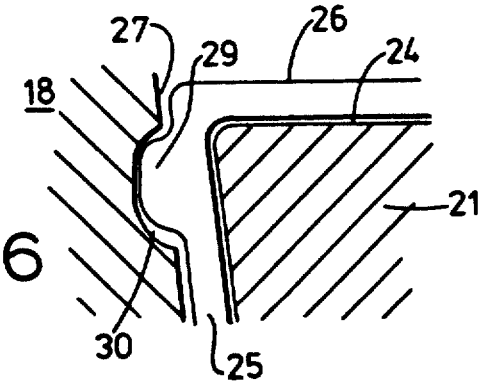
FIG. 6 is a schematic illustration of a protrusion and depression locking means modification of the protrusion retention means of FIG. 5.

Referring now to FIG. 6, boot 25 on wedge shaped end section 21 includes one or more protuberances 29 which may be located on a tapered side wall of boot 25 adjacent its end surface 26. Correspondingly the adjacent tapered sidewall of slot 27 includes one or more complementary depressions such as depression 30 of FIG. 6. Accordingly, the booted end of vane 13 slides into slot 27 with resilient protuberance 29 being compressed depending on the degree of interference fit available. Further sliding of vane end 21 into slot 27 brings protuberance 29 into registry with depression 30 and protuberance 29 expands into and engages depression 30 to accurately position and secure vane 13 in slot 27 in what may be referred to as a snap fit relationship while at the same time providing a resilient and tight fit with vibration damping characteristics. Protuberances as described may be located on other surfaces of a boot. One preferred location is on a tapered side surface of boot 25 adjacent the transverse end or base surface 24 of wedge section 21. Extensive variations of the protrusion depression locking means or resilient interference means may be devised including their number, location and geometry. For example, the protuberances may be in the slot wall and the corresponding depressions in the walls of the boot 24. Another modification is illustrated in FIG. 7 as a continuous rib or ridge kind of protuberance with a corresponding groove or channel to receive the ridge in locking relationship.

Figure 7:
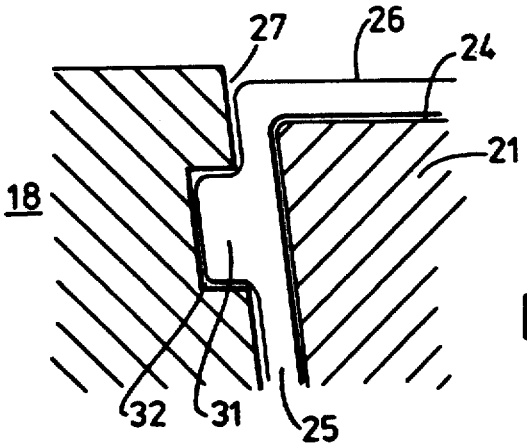
FIG. 7 is a schematic illustration of a rib and slot locking means modification of the protrusion depression means of FIG. 6.

Referring to FIG. 7, boot 25 which is fitted over a wedge shaped end 21 of a vane 13 includes a raised horizontal rib or ridge 31 on opposite sidewalls of boot 25 (only one side shown). Rib 31 extends horizontally along a sidewall of boot 25 adjacent end surface 24 and parallel to the plane thereof. Preferably, rib 31 is a continuous rib rather than a row of protuberances. Rib 31 is compressed while vane 13 slides in its groove 27 until rib/groove registry is reached with a corresponding groove 32 where rib 31 snaps into mating locking groove 32 to lock vane 13 in slot 27.

A vane support platform segment 18 may contain one or more vanes 13 and a plurality of segments are bolted to the fan casing 17 (FIG. 2) to provide a circular row of radially extending guide vanes in annular space 12, FIG. 1.

Figure 8:
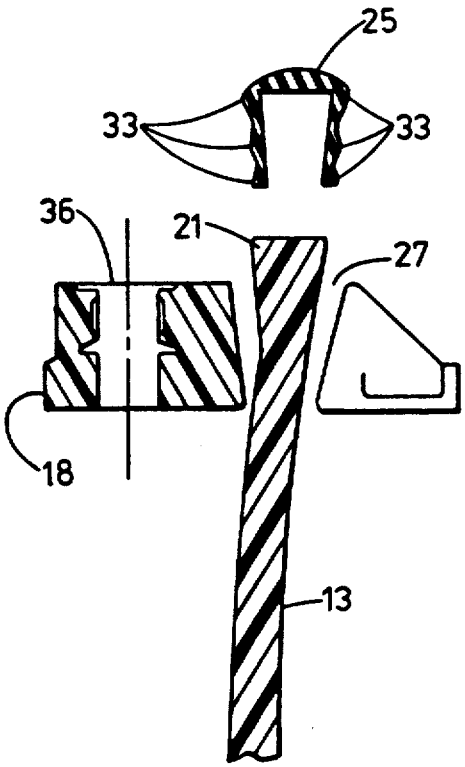
FIG. 8 is a cross sectional and exploded view of a guide vane subassembly comprising a composite vane, elastomer boot and vane support platform segment embodying the features of this invention.

A modification of the rib or ridge locking or fitting means of FIG. 7 is described with respect to FIG. 8.

Referring now to FIG. 8, a platform support segment 18 is illustrated as receiving a guide vane 13 in a wedge slot 27 therethrough with a vane wedge end 21 of vane 13 exposed. A compression molded elastomer boot member 25 of a suitable material as described, with tapered side surfaces which conform to wedge end 21, is closely fitted on wedge end 21. The tapered sidewalls of boot 25 are formed with corrugated like configurations which define a plurality of spaced apart horizontal, tapered ribs 33. In assembly, the boot end of vane 13 resides in its support platform 18 in slot 27 so that ribs 33 frictionally engage the side walls of slot 27 in compressing relationship for a good friction fit. The dimensions of boot 25 and slot 27 are correlated so that compression of adjacent ribs provides a swelling or flow of boot material into the intervening spaces for increased surface contact between boot 25 and the walls of slot 27. A maximum is achieved when all unoccupied volume between wedge end 21 and slot 27 becomes occupied by compression flow of boot 25 material. In this connection, and with reference to FIG. 2, assembly of the guide vane platform support segments 18 (FIG. 8) in the engine utilizes overlying casing 17 to which the segments are conveniently bolted in adjacent side by side relationship. Bolt attachment is accomplished, for example, by one or more bolts passing through one or more segment apertures 36 to be threaded into casing 17 which further prevents a vane 13 from moving out of its slot. As may be understood with respect to FIG. 1, vanes 13 are air flow control vanes mounted adjacent a bypass fan in an air duct or channel 12 of a hot gas turbine engine with a fan bypass arrangement. The present invention of guide vane support and retention facilitates effective mounting of the vanes in one vane support with a locking wedge or snap fit vibration damping mounting. It is expedient to have vanes 13 be quickly and easily hand assembled. By means of this invention only one end of a vane needs to be particularly fixed to a vane support which in the present invention, is the outer support 16 (FIG. 2). Utilization of the mounting assembly of this invention for vanes 13 in outer platform support 16 (FIG. 2) facilitates a less complex retention means for the inner ends of vanes 13 in inner support 14 (FIG. 2) as illustrated and described with respect to FIG. 9.

Figure 9:
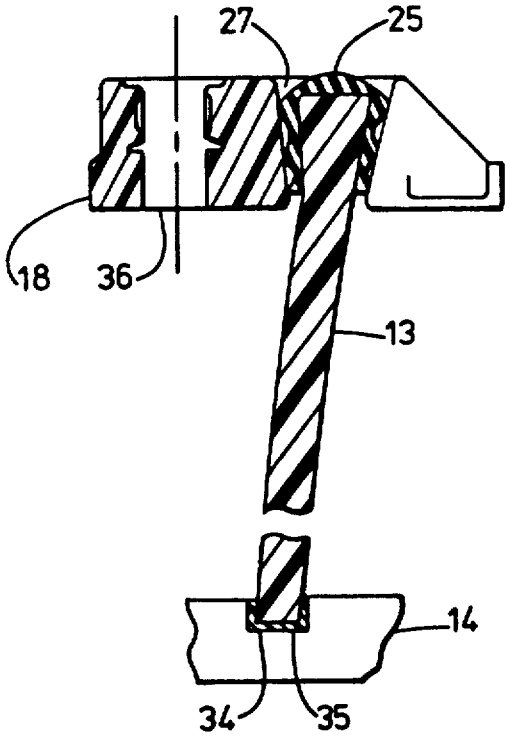
FIG. 9 is a cross sectional illustration of the assembled combination of FIG. 8 together with a schematic illustration of opposite end retention means.

Referring now to FIG. 9, inner support 14, only a short circular section of which is shown, may also comprise a plurality of arcuate segments assembled as a ring structure or an integral and unitary ring or band having a circular row of adjacent slots 34 (only one shown) therein, each of which underlies an opposite slot 27 in platform support segment 18. Slots 34 are lined with an elastomer material 35 which may be the form of a parallel side surfaced boot on vane 13. As described, vane 13 is inserted through slot 27 in platform segment 18 so that its wedge shaped end 21 with boot 25 thereon is fitted in the wedge shaped slot 27. The opposite end of vane 13 is inserted into lined slot 34 in inner support 14 in a stab fit or bayonet relationship which is suitable for retention purposes at that vane position.

This invention provides a unique guide vane subassembly which comprises a vane platform support segment having a wedge shaped slot therethrough, and an airfoil vane having a wedge shaped end section with an elastomer boot thereon. The guide vane is inserted through the slot in the platform segment until its booted wedge shaped end is closely fitted in the wedge shaped slot with a transverse surface of the boot exposed at the slot opening. The transverse surface of the boot or a protuberance therefrom projects a small amount from the plane of the slot opening. When the platform is bolted to a mating surface which covers the slot opening, an interference is established between the boot, or its protuberance, and the mating surface so that a compression force is established on the boot or its protuberance to bias the vane wedge section into the slot.

Such a subassembly as described is more clearly illustrated in FIG. 8 which includes vane 13, platform support segment 16, wedge end 20 of vane 13, and boot 24. In the subassembly as described the snap fit or lock means of FIGS. 6 and 7 may also be utilized.

While this invention has been disclosed and described with respect to preferred embodiments thereof, it will be apparent to those skilled in the art that changes and modifications may be made thereto without departing from the spirit and scope of the invention as set forth in the following claims.

What is claimed is:

1. An air flow vane structure adapted for mounting in an air duct in an air flow stream comprising in combination, a platform support segment with an airfoil vane extending radially therefrom and fixedly secured to said segment by a vibration damping securing assembly, said securing assembly comprising:

(a) said airfoil vane having an outwardly tapering wedge shaped section on an end adjacent said platform support segment;, (b) an elastomer material boot member having a complementary wedge shape with tapered side walls and a transverse planar end surface, said boot member being fitted on said airfoil vane wedge section in close fitting relationship and including vane securing means on a surface thereof;

(c) said platform support segment defining therethrough an open airfoil shaped slot having spaced side walls with a complementary taper corresponding to the taper of said airfoil vane wedge section;

(d) said airfoil vane being positioned to be aligned with said slot in said platform support segment and slidable therethrough to bring said airfoil vane wedge shaped section into said slot in a dovetail joint relationship, said boot member being compressed between the wedge section and the walls of said slot in vibration damping relationship.

2. The invention as recited in claim 1 wherein said boot comprises a fluoro elastomer material.

3. The invention as recited in claim 1 wherein said vane securing means comprises at least one raised resilient protuberance on said boot so that said protuberance is resiliently compressed between said wedge shaped section and a wall of said slot in said dovetail joint relationship.

4. The invention as recited in claim 3 wherein a wall of said slot contains a protuberance matching depression to receive and contain said boot protuberance therein in said dovetail joint relationship.

5. The invention as recited in claim 1 wherein said wedge section includes a transverse planar end surface and said boot includes a corresponding transverse planar end surface with said protuberance being on said end surface of said planar boot to project from said slot a predetermined amount.

6. The invention as recited in claim 3 wherein said raised protuberance is hemispherical.

7. The invention as recited in claim 3 wherein said raised resilient protuberance is at least one raised rib extending horizontally along a tapered surface of said boot and parallel to said transverse planar end surface to be resiliently compressed by a wall of said slot.

8. The invention as recited in claim 7 wherein said wall of said slot includes a matching horizontal groove therein adapted to receive and contain said rib therein in locking relationship upon registry of said rib with said groove during insertion of said wedge section into said slot.

9. An outlet guide vane subsassembly for a bypass fan of a gas turbine engine, comprising in combination:

(a) a vane platform segment having an airfoil shaped slot therethrough with tapering wedge sidewalls;

(b) an airfoil shaped guide vane having a wedge shaped end section thereon;

(c) a hollow tapered surface wedge shaped fluoro elastomer boot closely fitting on said vane end section; and (d) at least one raised protuberance on a tapered wedge surface of said boot;

wherein said guide vane is inserted axially into said slot in said platform so that said vane end section with said boot thereon fit closely in said slot and abut said tapering wedge sidewalls of said slot with said protuberance being resiliently compressed by said wedge sidewalls of said slot.

* * * * *